United States Patent [19]

Aubert

[11] Patent Number: 4,743,879

[45] Date of Patent: May 10, 1988

[54] SOLENOIDAL MAGNET WITH HIGH MAGNETIC FIELD HOMOGENEITY

[75] Inventor: Guy Aubert, Grenoble, France

[73] Assignee: Thomson-CGR, Grenoble, France

[21] Appl. No.: 14,048

[22] PCT Filed: Apr. 22, 1986

[86] PCT No.: PCT/FR86/00136

§ 371 Date: Jan. 6, 1987

§ 102(e) Date: Jan. 6, 1987

[87] PCT Pub. No.: WO86/06869

PCT Pub. Date: Nov. 20, 1986

[30] Foreign Application Priority Data

May 10, 1985 [FR] France ..... 85 07151

[51] Int. Cl.[4] ..... H01F 5/00

[52] U.S. Cl. ..... 335/299; 335/300; 439/883

[58] Field of Search ..... 335/216, 299, 296; 439/883; 336/232

[56] References Cited

U.S. PATENT DOCUMENTS 3,281,737 10/1966 Swartz ..... 335/299 X

FOREIGN PATENT DOCUMENTS 1491786 7/1967 France ..... 335/299
153863 5/1982 Japan ..... 335/299
232831 7/1984 Japan ..... 335/296

OTHER PUBLICATIONS

Journal of Physics E, Scientific Instr., vol. 6, No. 4, Apr., 1973, C. B. Wheeler et al., Multiply Crowbarred Solenoids for Plasma Research, pp. 332–338.

*Primary Examiner*—George Harris
*Attorney, Agent, or Firm*—Oblon, Fisher, Spivak, McClelland & Maier

[57] ABSTRACT

A solenoidal magnet is provided with high magnetic field homogeneity, including a connection structure between spaced coils. The current between two adjacent spaced coils is transmitted in one direction by a longitudinal conductor and in the other direction by two longitudinal conductors disposed on each side of said first conductor.

5 Claims, 1 Drawing Sheet

SOLENOIDAL MAGNET WITH HIGH MAGNETIC FIELD HOMOGENEITY

BACKGROUND OF THE INVENTION

1. Field of the Invention

The invention, due to the collaboration of the Service National des Champs Intenses of the CNRS (Director M. AUBERT) generally relates to a solenoidal magnet with high magnetic field homogeneity, formed of several coils spaced apart from each other; it relates more particularly to a connection structure between the coils avoiding the creation of parasite field components.

It is known that NMR (nuclear magnetic resonance) image forming installations require a large sized magnet capable of generating a uniform magnetic field in a given region of space. Typically, it is necessary to generate a magnetic field of 0.15 to 0.5 teslas with a homogeneity of 1 to 10 parts per million (ppm) in a sphere with a diameter of 40 cm at least.

2. Description of the Prior Art

It is known to form such a magnet from an assembly of coils spaced apart from each other by chosen distances along a common axis. In another patent application, the applicant describes a method for calculating the characteristics of such a magnet formed of coils all having the same inner and outer diameter and formed more particularly of Bitter type coils. In calculating such a magnet, it is assumed that no current flowing in the spaces between the coils is likely to create a magnetic field. Now, the coils are connected together in series and connecting conductors necessarily pass through these spaces. The invention relates more specifically to a connection structure between coils, adapted so as to avoid the formation of parasite field components between said coils.

SUMMARY OF THE INVENTION

With this in mind, the invention relates to a solenoidal magnet with high magnetic field homogeneity having several coils of the same inner and outer diameter spaced along a common longitudinal axis, wherein said coils are connected together in series by first conductors disposed parallel to said axis and extending respectively through said spaces between said coils, second conductors are disposed longitudinally in the vicinity of said first conductors and these second conductors are connected to third conductors formed and/or disposed over the length of each coil so as to distribute a current flow substantially uniformly over a cylindrical surface coaxial to said axis, said second and third conductors being interconnected and connected together in series with said coils so as to ensure the current return towards an axial end of said magnet.

The coils forming the above described magnet are preferably Bitter coils. Bitter coils are well known for the production of intense magnetic fields. The structure proposed by Bitter is a coil formed of annular metal disks (generally made from copper or aluminum), split so as to form as many turns and connected together so as to define a substantially helical winding with flat turns. The stack of disks is held together by a plurality of tie rods. This structure is advantageous for it allows efficient cooling of the magnet, by forming holes in the disks (and in the insulators separating these disks), these holes being disposed in the same configuration from one disk to another so as to materialize an assembly of channels parallel to the axis of the coil, in which flows a cooling fluid, for example deionized water, kerosene or oil.

The invention applies preferably to a magnet constructed from such Bitter coils to the extent that, more particularly, at least some of said tie rods may be used for forming said third conductors, distributing the return current over a substantially cylindrical surface coaxial with the coils, in the sections of the magnet occupied by these latter. In this embodiment, the ends of the tie rods may be connected electrically together by placing at each axial end of each coil an open ring, that is to say having a radial slit through which is established the connection point between said first corresponding conductor and said coil. The ring is of course isolated from the coil and a pair of said second conductors is disposed on each side of said first conductor, each second conductor being connected to one end of said ring. With such a structure, the distribution of the current return in the tie rods of the different coils is substantially balanced when each coil comprises an uneven number of half turns.

BRIEF DESCRIPTION OF THE DRAWINGS

The invention will be more clearly understood from the following description of one embodiment, at present preferred, of a magnet conforming to its principle, given solely by way of example with reference to the accompanying drawings in which.

DESCRIPTION OF THE PREFERRED EMBODIMENTS

Figure 1:
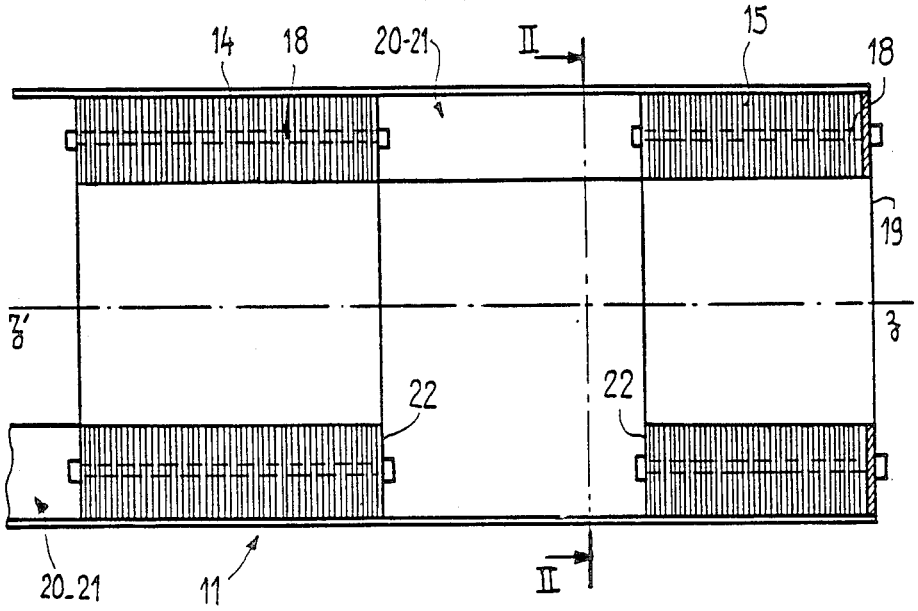
FIG. 1 is a schematical representation of a part of a magnet conforming to the principle of the invention, illustrating more particularly a connection structure between two adjacent coils.

Referring to the drawings, a part of a solenoidal magnet 11 is shown comprising annular Bitter disks, known per se, formed of several coils aligned along the same main axis of symmetry Z'Z. More precisely, the two coils 14 and 15 have been shown the closest to an axial end of the magnet opposite the one where means are provided for connection to a DC power supply source, not shown. Thus, for an application to NMR image formation, it is possible to obtain a magnetic field having the required homogeneity in a sphere of interest of sufficient volume whose center merges with that of the magnet, from a set of seven coils for example, by choosing the length of these coils and the spacing therebetween. One possible method of calculating the characteristics of the coils of the magnet and the spacing between these coils is given in another French patent application No. 84-19191 filed by the applicant and this method of calculation does not form part of the invention described here.

By Bitter coil is meant any coil corresponding to the above recalled definition. Thus, the radially split disks forming the turns are connected, for example welded, end to end and are held in a tight stack by means of a plurality of tie rods 18 spaced evenly apart over a cylindrical surface with axis z'z. All the coils are connected together in series. The tie rods 18 are proper to each coil; they do not extend into the spaces defined therebetween, they are of course electrically isolated from the Bitter disks which they hold in position. The tie rods, or some of them, are further used for bringing the current back to the current source, that is to say towards the axial end of the magnet which is not shown. For that, a current distribution plate 19 (not split) is situated at the external end of coil 15 and is welded to the last turn thereof so as to ensure substantially uniform distribution of the return current flow between the tie rods, which are in electric contact with said distribution plate. The tie rods of each coil are connected together at both ends of this coil so as to define a sort of squirrel cage. The interconnection of the tie rods will be described further on. In the sections of the magnet occupied by the coils, the tie rods have flowing therethrough substantially equal fractions of the return current. They thus compensate for the small axial current component due to the helix of the winding defined by the Bitter disks, in the corresponding coil. Of course, it is not indispensable to use the tie rods of the Bitter coils for compensating for the axial component of the current which flows through said coil. A simple cylindrical tubular casing may be used external to the coils and coaxial for providing the current return substantially uniformly over a cylindrical surface with axis z'z in each section of the magnet occupied by a coil. Thus a "squirrel cage" may also be used defined from other conducting rods than the tie rods.

According to an important characteristic of the invention, the coils are connected together in series by first conductors such as 20 extending respectively in the spaces between adjacent coils whereas second conductors 21, participating in the current return, are disposed longitudinally in the vicinity of said first conductors so as to surround them at least partially. In the example described, each conductor 20, 21 has a rectangular section and two conductors 21, isolated from conductor 20, are disposed side by side along two parallel faces thereof. The whole of the current flowing through the coils flows then through each conductor 20 whereas the return current flowing in the reverse direction is divided substantially equally between the two conductors 21. The connection structure between two coils, which has just been described, creates no parasite field in the space between the two coils considered. Furthermore, the continuity of the current return circuit is provided by third conductors interconnected between the second conductors, these third conductors being formed simply, in the example described, by the groups of tie rods 18 associated with the different coils or at least a part of these tie rods evenly spaced apart from each other. The second conductors 21 and the tie rods 18 are connected in series as a whole with the coils themselves in series, by means of the distribution plate 19. The connections between said second conductors and the groups of tie rods are provided by open rings 22 disposed at the axial ends of the coils and with which the tie rods 18 on the one hand and the ends of conductors 21 on the other are interconnected. More precisely, each ring, isolated from the coil at the end of which it is fixed by means of tie rods, includes a slit 23 in which is situated the connection point between the first conductor 20 and the end of the corresponding coil whereas the ends 24 of the ring materialized by slit 23 are connected to the ends of the two corresponding conductors 21. Furthermore, the tie rods of each coil pass through the corresponding rings 22 (one ring and plate 19 in so far as coil 15 is concerned) and are clamped by means of nuts between said rings, which ensures a correct electric contact between these rings and these tie rods.

Figure 2:
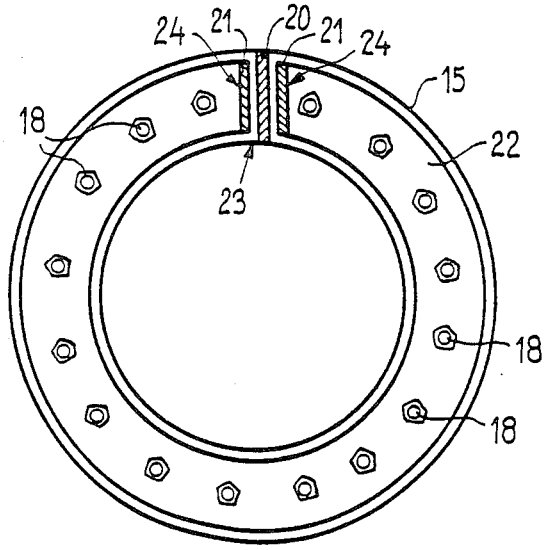
FIG. 2 is a section through II—II of FIG. 1.

According to another important feature of the invention, each coil includes an uneven number of half turns so that, on each side of the same coil, the arrangements of conductors 20, 21 are opposite with respect to axis z'z. In fact, referring to the example shown in FIG. 2, it can be seen that the tie rods 18 are "spaced" from the connection points of conductors 21 to ring 22 by a greater or lesser distance and this spacing depends on the position of the tie rod considered with respect to slit 23. Differences of intensity between the currents flowing in the tie rods might result therefrom, because of the greater or lesser portion of ring 22 placed in series with each of them. Such imbalance is avoided if the coil has a whole number of half turns for, in this case, the tie rods the "furthest away" from conductors 21 at an axial end of the coil are the closest to the homologous conductors 21 at the other axial end of this same coil. Consequently, the resistances distributed between the tie rods by the presence of the rings are substantially equal so that the current return is divided substantially evenly between the tie rods in each coil and is divided substantially into two equal fractions in conductors 21 in each space between two adjacent coils.

What is claimed is:

1. A solenoidal magnet with high magnetic field homogeneity including several coils of the same inner and outer diameter, spaced apart along a common longitudinal axis, wherein said coils are connected together in series by first conductors disposed parallel to said axis and extending respectively in the spaces between said coils;

second conductors are disposed longitudinally in the vicinity of said first conductors; and the second conductors are connected to third conductors disposed over the length of each coil so as to distribute a current flow substantially uniform over a cylindrical surface coaxial to said axis;

said second and third conductors being interconnected and connected together as a whole in series with said coils so as to ensure the current return to an axial end of said magnet.

2. The solenoidal magnet according to claim 1, of the type in which said coils are Bitter coils, wherein disks of each coil are held in position by tie rods isolated therefrom and spaced evenly apart over a cylindrical coaxial surface; and said third conductors are formed by at least some of said tie rods spaced evenly from each other.

3. The solenoidal magnet according to claims 1 or 2, including:

in each space between two adjacent coils, a said first conductor and two said second conductors disposed side by side symmetrically along said first conductor.

4. The magnet according to claim 2 wherein, in the vicinity of each coil, said second conductors are connected to the ends of an open ring, the connection point between said first conductor and the corresponding coil is placed in the opening of said ring; and each said ring, isolated from the coil at the end of which it is mounted, is connected to said tie rods forming said third conductors.

5. The solenoidal magnet according to claim 1, wherein each coil includes an uneven number of half turns.

* * * * *